US006833067B2

(12) United States Patent
Dresmann

(10) Patent No.: US 6,833,067 B2
(45) Date of Patent: Dec. 21, 2004

(54) DEVICE FOR DRAINING FLAT ROOFS, BALCONIES, TERRACES OR OTHER FLAT STRUCTURES

(75) Inventor: Markus Dresmann, Herzebrock-Clarholz (DE)

(73) Assignee: Sita Bauelemente GmbH, Herzebrock-Clarholz (DE)

( * ) Notice: Subject to any disclaimer, the term of this patent is extended or adjusted under 35 U.S.C. 154(b) by 0 days.

(21) Appl. No.: 10/437,786

(22) Filed: May 14, 2003

(65) Prior Publication Data

US 2003/0201217 A1 Oct. 30, 2003

Related U.S. Application Data

(63) Continuation of application No. PCT/EP01/13286, filed on Nov. 16, 2001.

(30) Foreign Application Priority Data

Nov. 17, 2000 (DE) ..... 100 57 197

(51) Int. Cl.[7] ..... E04D 13/04

(52) U.S. Cl. ..... 210/163; 210/170; 210/416.1; 210/460; 52/302.1

(58) Field of Search ..... 210/163, 164, 210/166, 170, 416.1, 459, 460, 474; 52/199, 302.1, 302.7

(56) References Cited

U.S. PATENT DOCUMENTS

| | | | | |
|---|---|---|---|---|
| 1,858,268 A | | 5/1932 | Fleming | |
| 3,378,858 A | * | 4/1968 | Jacuzzi | 210/163 |
| 3,884,809 A | * | 5/1975 | Logsdon | 210/163 |
| 4,460,462 A | | 7/1984 | Arneson | |
| 5,378,356 A | | 1/1995 | Logsdon | |
| 5,394,657 A | * | 3/1995 | Peterson | 210/166 |
| 5,408,706 A | | 4/1995 | Barnes | |
| 5,618,416 A | * | 4/1997 | Haefner | 210/163 |
| 5,724,777 A | * | 3/1998 | Hubbard | 52/302.1 |
| 5,759,414 A | * | 6/1998 | Wilkes et al. | 210/163 |
| 6,594,966 B2 | * | 7/2003 | Froeter | 52/302.1 |

FOREIGN PATENT DOCUMENTS

| | | |
|---|---|---|
| DE | 198 19 116 A1 | 1/1999 |
| DE | 298 21 255 U1 | 5/1999 |
| GB | 2 321 067 A | 7/1998 |

* cited by examiner

*Primary Examiner*—Christopher Upton
(74) *Attorney, Agent, or Firm*—Laurence A. Greenberg; Werner H. Stemer; Ralph E. Locher

(57) ABSTRACT

A drain device for draining flat roofs, balconies, terraces or other flat structures, has an inflow body provided with a collar rim. When the inflow body is mounted, the collar rim lies on the surface of the roof. A loose flange can be introduced into the inflow body. The flange also has a collar rim. A connector film can be tensed between the collar rims of the inflow body and the loose flange for establishing a tight connection of a covering layer between said two elements. In order to allow for abnormally large amounts of water to be drained, the inflow body is provided with a cavity, into which two drain pipes and lead. One of the drain pipes co-operates with a pressurized, i.e., a pumped drainage system, and the other one of the drain pipes cooperates with a free-flowing drainage system.

7 Claims, 3 Drawing Sheets

DEVICE FOR DRAINING FLAT ROOFS, BALCONIES, TERRACES OR OTHER FLAT STRUCTURES

CROSS-REFERENCE TO RELATED APPLICATION

This application is a continuation of copending International Application No. PCT/EP01/13286, filed Nov. 16, 2001, which designated the United States and which was not published in English.

BACKGROUND OF THE INVENTION

Field of the Invention

The invention relates to a device for draining flat roofs, balconies, terraces or other flat structures. The device of the generic type comprises an inlet body with a collar rim which, with the inlet body in the installed state, rests on the roof surface, and where a loose flange, which likewise has a collar rim, can be fitted into the inlet, and where a connecting sheet is let in between the collar rim of the inlet body and the loose flange. The sheet can be braced between them to produce a leaktight connection for a covering layer.

Such devices are used for channeling into a discharge pipe, in a targeted and reliable manner, the water which accumulates on the surface of a flat roof, a terrace or a balcony. It is of importance here that the edge region of the opening in the structural body is sealed in such a way that the water does not run down along the walls, but is channeled into the discharge pipe in a targeted manner. Such devices are also referred to as a gully, the gully comprising an inlet body, which is usually of funnel-shaped design, and a loose flange which can be fitted into the inlet body. In order to be able to produce a reliable and leaktight connection, for example on a bitumen sheet, the loose flange is fitted onto the inlet body and can be braced on the latter. For this purpose, both the inlet body and the loose flange have a collar rim which, in the fitted state, has a gap in which the connecting sheet or the bitumen sheet can then be inserted.

In roof drainage, a distinction is made between two drainage principles, with the free-flow system adopting many downpipes for drainage, whereas the pressure drainage system drains only by way of a small number of downpipes. The efficiency of the pressure water system is frequently impaired by the fact that air is concomitantly sucked in during drainage, which spontaneously appears in the form of a water eddy and a cone of air which forms in the inlet body. The flow of the water in the pipe is thereby impaired, thus lessening the drainage performance of the pressure drainage installation. Moreover, the pressure drainage system offers no guarantee that, for example during the occurrence of exceptionally heavy rainfall, the quantities of water accumulating can be drained off using a pressure water system. For this purpose, it is then necessary for a free-flow system having to be adopted in order to ensure reliable drainage of the roof surfaces. The same also applies to simple drainage using a downpipe.

SUMMARY OF THE INVENTION

It is accordingly an object of the invention to provide a drainage device for a flat structure which overcomes the above-mentioned disadvantages of the heretofore-known devices and methods of this general type and which further develops a drainage system in such a way that the possibility is also offered, in particular, of processing quantities of water resulting from exceptionally heavy rainfall.

With the foregoing and other objects in view there is provided, in accordance with the invention, a device for draining a flat structure (e.g., flat roof, balcony, terrace, patio, or the like), comprising:

- an inlet body formed with an inlet and with a collar rim to be placed on a surface of the flat structure when the device is installed, and with a chamber having a substantially flat base;
- a loose flange member having a collar rim and being formed to be fitted into said inlet, wherein said collar rim of said inlet body and said collar rim of said loose flange member form a space to accommodate a connecting sheet and bracing the connecting sheet therebetween to produce a leaktight connection for a covering layer;
- a first drainpipe and a second drainpipe each communicating with said chamber of said inlet body and connected to pressure drainage and free-flow drainage systems;
- said first drainpipe having an inlet socket lying directly in said base of said chamber and said second drainpipe having an inlet socket above said chamber.

In other words, the objects of the invention are achieved in that the inlet body has a chamber in which two drainpipes open out, the one drainpipe and the other drainpipe interacting with pressure or free-flow drainage systems. By virtue of the combination of two drainage systems or the combination of two drainpipes in an inlet body, a situation is achieved in which the well-established pressure drainage system on the one hand with a free-flow drainage system on the other hand can be arranged in combination in an inlet body. Thus it is possible, as a result of the installation of an inlet body, for the normal quantity of accumulating rainwater to be removed from the roof surface, it also being possible, especially if exceptionally heavy rainfall should occur, for a significantly larger quantity of water to be drained off by means of the same drainage device, said quantity then correspondingly running off through the larger drainpipe. This combination of the drainage systems results in the individual installed gully having greater reliability with regard to the water to be drained off, it being the case that a gully of such design is to be used where the threatened quantities of water may occur on the roof.

In this respect, the inlet chamber advantageously has substantially a base of flat design in which, on the one hand, the inlet socket of the drainpipe opens out directly in the base of the inlet body, the inlet socket of the other drainpipe protruding through the flat-design base of the inlet body and its inlet socket thus opening out above the inlet chamber. Thus it is ensured that, on the one hand, the drainage system operates in a trouble-free manner in the chamber by the inlet chamber initially filling with water, with the result that the drainpipe opening out in the base of the inlet chamber is filled. If the quantity of accumulating rain increases, then the water level in the inlet chamber rises until it approximately reaches the horizon of the inlet socket of the other drainpipe. As a consequence of the larger diameter of the drainpipe for free-flow drainage, the correspondingly excessively accumulating quantity of rain can then be drained off through the drainpipe of the free-flow drainage.

In accordance with an added feature of the invention, there is provided a disk-shaped cover with an opening through which the inlet socket of the free-flow drainage protrudes on the loose flange by means of spacer elements. This makes possible a radial flow into the chamber of the inlet body.

To avoid the occurrence of eddies in the inlet socket of the drainpipe for pressure drainage, a further cover for the inlet socket is arranged underneath the cover, insofar as said socket interacts with a pressure drainage system. The cover has the effect that there is also established a radial flow for the inlet socket of the pressure drainage in the region of the inlet chamber.

In accordance with an advantageous development of the invention, the cover for the pressure drainage likewise comprises a disk, which is arranged with a spacing from the inlet socket. In a development of the invention, a gravel-trapping strainer can be locked on the cover.

Other features which are considered as characteristic for the invention are set forth in the appended claims.

Although the invention is illustrated and described herein as embodied in a device for draining flat roofs, balconies, terraces or other flat structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
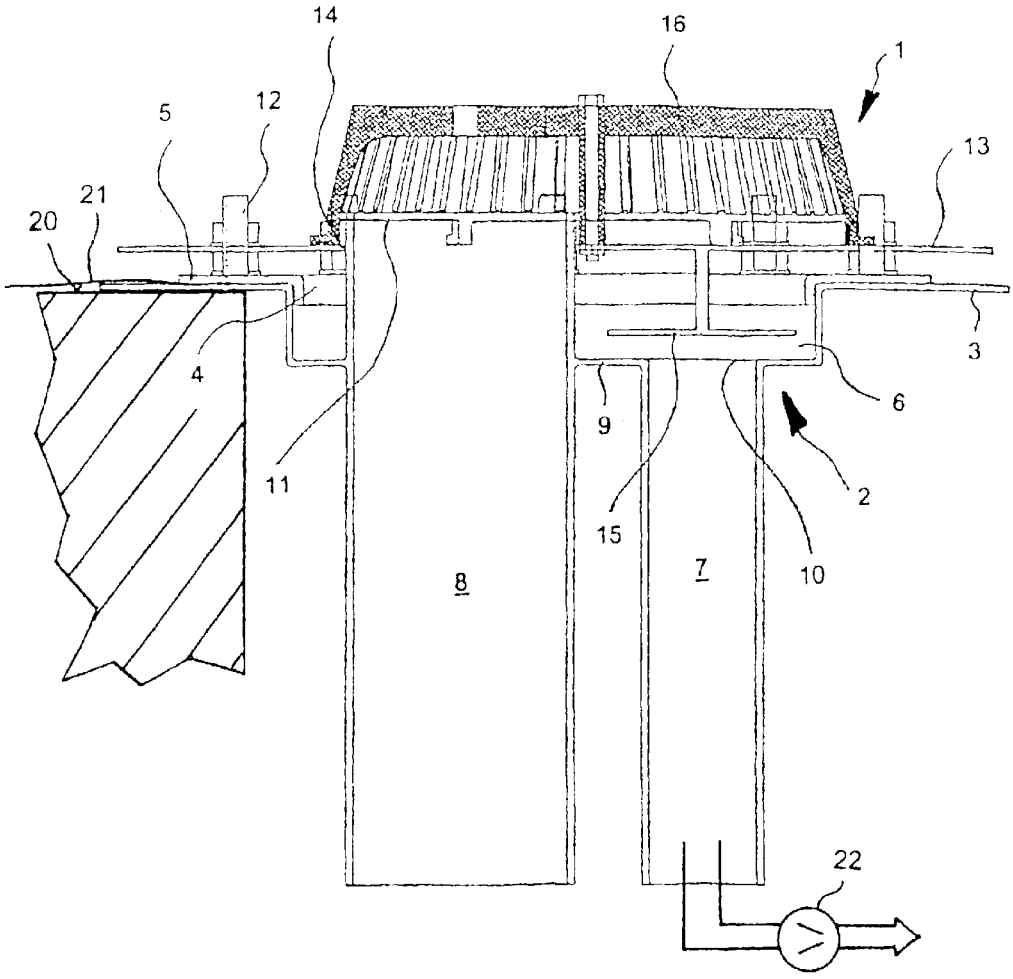
FIG. 1 is a sectional side elevation of a drainage device with gravel-trapping strainer according to the invention.

Referring now to the figures of the drawing in detail and first, particularly, to FIG. 1 thereof, there is shown, in side elevation and in section, a device 1 for draining flat roofs, balconies, terraces or other flat structures. The device 1 here comprises an inlet body 2 on which a collar rim 3 has been integrally formed. When the device is installed, the collar rim 3 rests on a roof surface 20. A loose flange 4, which likewise has a collar rim 5, can be fitted into the inlet 2. A connecting sheet 21 can be allowed to extend in between the collar rim 3 of the inlet body 2 and the loose flange 4. The sheet 21 can be sandwiched and braced between the flange rims 3 and 5 for producing a leaktight connection for a roof layer. As can be seen from the side elevation of FIG. 1 but also from FIG. 2, the inlet body 2 has a chamber 6 in which two drainpipes 7 and 8 open out, the one drainpipe 7 interacting with a pressure drainage system (schematically indicated by a pump 22) and the other drainpipe 8 interacting with a free-flow drainage system.

Figure 2:
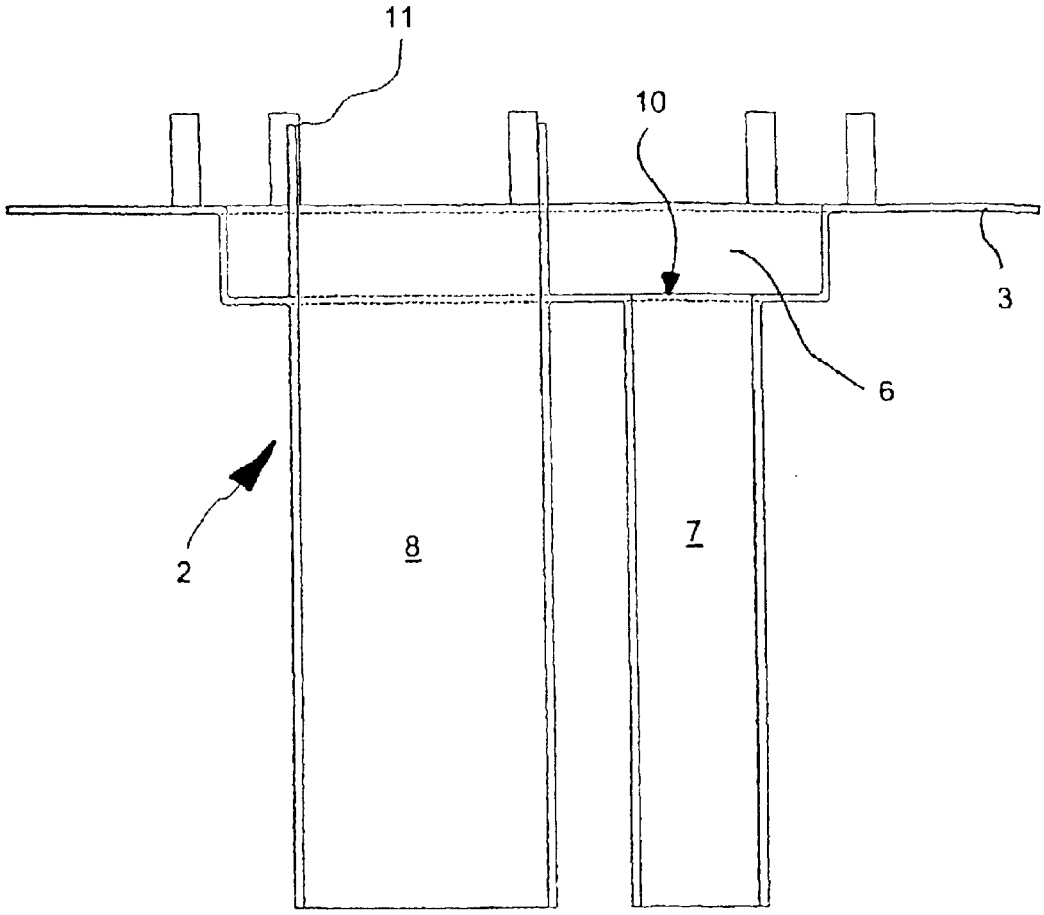
FIG. 2 is a further side elevation of the inlet body according to FIG. 1.
Figure 4:
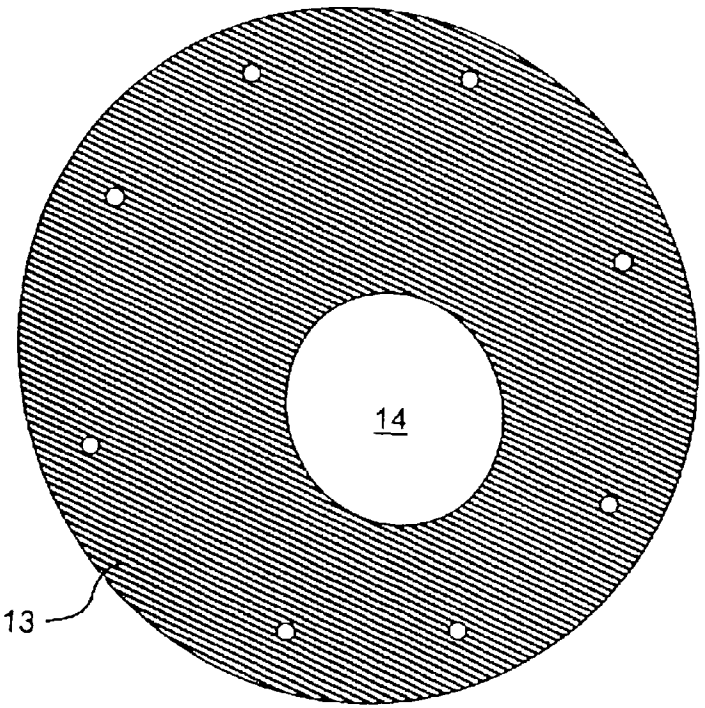
FIG. 4 is a further plan view of a disk-shaped cover formed with an opening.
Figure 3:
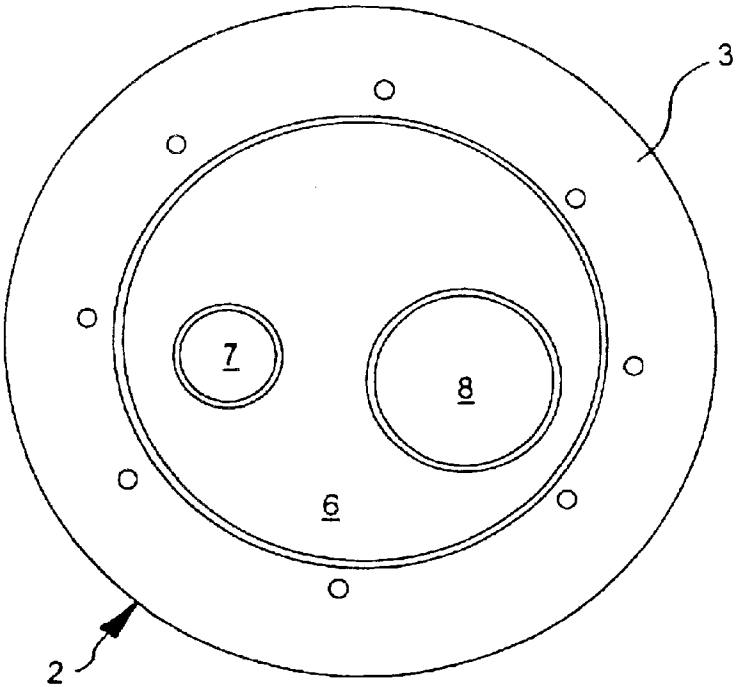
FIG. 3 is a plan view of the chamber of the inlet body.

As can be seen from FIGS. 1 and 2, the inlet chamber 6 has substantially a base 9 of flat design. In this case, for the purpose of pressure drainage, the drainpipe 7 opens out with its inlet socket 10 directly into the base 9 of the inlet chamber 6. The drainpipe 8, which is intended for free-flow drainage, protrudes through the base 9, with its inlet socket 11 terminating above the inlet chamber 6. As can be seen, in particular, from FIGS. 1 and 2, a disk-shaped cover 13 with an opening 14 through which the inlet socket 11 of the free-flow drainage protrudes is provided on the loose flange 4 by means of spacer elements 12. The cover 13, in isolated representation, is again shown in plan view in FIG. 4, where there can be seen first of all the openings which interact with the spacer elements 12, and where there can be seen, in a correspondingly eccentrically mounted manner, the opening 14 through which the inlet socket 11 of the free-flow drainage protrudes.

In this context, as can further be seen in FIG. 1, there is provided below the cover 13 a further cover 15 which is intended for the inlet socket 10 of the pressure drainage system. Here, the cover 15 comes to lie with a spacing above the inlet socket 10, with the result that, when the inlet chamber 6 is filled, a radial flow is established for the inlet socket 10 in order, in particular, to prevent the formation of water eddies in the drainpipe 7. In this arrangement, the cover 15 for the pressure drainage likewise comprises a disk, which is arranged with a spacing from the inlet socket 10. It is also possible here for a gravel-trapping strainer 16 to be arranged in a locking manner on the cover 13 in a known way.

In the device 1 according to the invention for drainage, the accumulating rainwater will initially flow radially into the chamber 6 of the inlet body 2, the pressure drainage system taking effect via the inlet socket 10. If the water rises further, with the result that the inlet chamber 6 is filled and the quantity of water exceeds a volume whereby the pressure drainage system no longer has the sufficient absorption quantity, then the water level passes over and above the disk-shaped cover 13 until it reaches the inlet socket 11 of the drainpipe 8 for free-flow drainage.

I claim:

1. A device for draining a flat structure, comprising:

an inlet body formed with an inlet and with a collar rim to be placed on a surface of the flat structure when the device is installed, and with a chamber having a substantially flat base;

a loose flange member having a collar rim and being formed to be fitted into said inlet, wherein said collar rim of said inlet body and said collar rim of said loose flange member form a space to accommodate a connecting sheet and bracing the connecting sheet therebetween to produce a leaktight connection for a covering layer;

a first drainpipe for connecting to a pressure drainage system and a second drainpipe for connecting to a free-flow drainage system each communicating with said chamber of said inlet body; said first drainpipe having an inlet lying directly in said base of said chamber and said second drainpipe having an inlet above said chamber.

2. The device according to claim 1, which comprises a disk-shaped cover formed with an opening communicating with said inlet of said second drainpipe, and spacer elements supporting said cover on said loose flange.

3. The device according to claim 2, wherein said first drainpipe communicates with the pressure drainage system and a further cover is disposed at said inlet of said first drainpipe underneath said disk-shaped cover.

4. The device according to claim 3, wherein said further cover for the pressure drainage comprises a disk, and said disk is disposed at a spacing distance from said inlet of said first drainpipe.

5. The device according to claim 1, which comprises a disk-shaped cover above said chamber and a gravel-trapping strainer to be locked on said disk-shaped cover.

6. The device according to claim 1, wherein said inlet of said first drainpipe is disposed geodetically below a level of the surface of the flat structure and said inlet of said second drainpipe is disposed geodetically above the surface of the flat structure.

7. The device according to claim 6, wherein said first drainpipe belongs to the free-flow drainage and said second drainpipe is connected to the pressure drainage system.

* * * * *